US005605508A

United States Patent [19]

Schmeelk et al.

[11] Patent Number: 5,605,508

[45] Date of Patent: Feb. 25, 1997

[54] MAGICIANS' GUILLOTINE APPARATUS

[75] Inventors: William J. Schmeelk, 15 Birchwood La., Hillsdale, N.J. 07642; Alan Wakeling, Westlake Village, Calif.

[73] Assignee: William J. Schmeelk, Hillsdale, N.J.

[21] Appl. No.: 547,029

[22] Filed: Oct. 23, 1995

[51] Int. Cl.[6] ..... A63J 21/00

[52] U.S. Cl. ..... 472/69; 472/71

[58] Field of Search ..... 472/69, 71, 137, 472/57, 51; 40/427

[56] References Cited

U.S. PATENT DOCUMENTS

| | | | |
|---|---|---|---|
| 1,500,507 | 7/1924 | Levy | 472/69 |
| 4,068,841 | 1/1978 | Kuna et al. | 472/69 |

OTHER PUBLICATIONS

'Night Club Illusions' Published by Abbott's Magic, Colon Michigan, Date Unknown, Admitted Prior Art pp. 139,140. The Lester Lake Guillotine, Date Unknown Admitted Prior Ar.

*Primary Examiner*—Kien T. Nguyen
*Attorney, Agent, or Firm*—Robert W. J. Usher

[57] ABSTRACT

A magician's guillotine has generally transparent stocks providing a primary, central neck receiving aperture and surrounding upper, lower and lateral demonstration apertures for demo articles to be severed. Opposite edges of the stocks are mounted in frame uprights having first and second vertical tracks for receiving an upper blade assembly which is switched to descend in a first track to extend across and sever demo articles in upper, lateral and primary apertures and in a second track to extend across and sever only articles in the upper and lateral demonstration apertures. When the blade assembly descends in the second track a lower blade rises from a concealed position inside the frame to sever a demo article in the lower aperture. The upper blade assembly has a first blade of inverted U-shape concealed within a second, rectangular tubular blade when in the first track and sliding therefrom when in the second track to sever only demo articles in the upper and lateral apertures. Masking around the primary aperture conceals the upper edge of the raised lower blade and inner, vertical and horizontal edges of the descended first blade. A handle of the blade assembly has a face plate so aligned with the second blade as to appear to be a continuation thereof.

11 Claims, 7 Drawing Sheets

MAGICIANS' GUILLOTINE APPARATUS

FIELD OF THE INVENTION

The invention relates to a magicians' guillotine apparatus of the kind providing the illusion that a descending guillotine blade has or should have passed through a body part of a subject held in stocks thereof.

BACKGROUND OF THE INVENTION

Magician's guillotines of the above type have been known and widely used for many years and can sever one or more articles held in apertures in the stocks without severing a subject's neck.

In one prior type of apparatus, an article held in a demonstration aperture below an aperture receiving the subjects neck is actually severed by the descending blade. Such apparatus usually comprise two blade portions the descent of one of which starts and stops above the neck and the descent of the other starts below the neck.

A disadvantage of such approach is that the demonstration apertures are not on each lateral side and the distance between the neck holding aperture and the demonstration aperture must be relatively large to accommodate the lower blade.

In another approach described in "Illusions", pages 139/140, admitted prior art, the apparatus severs demonstration articles held in apertures on each lateral side of and level with the central, neck holding aperture. Such apparatus comprise an assembly of an inverted U-shape blade and a rectangular blade extending completely thereacross. In a first demonstration, the blades are linked together by pins passing therethrough and an article held in the central aperture (or all three) is severed. In a second demonstration, the pins are removed so that during descent the rectangular blade is stopped by the subjects neck being progressively inserted into the handle during the further descent of only the U-shaped lower blade so that-lower ends of legs thereof sever only articles placed in the lateral apertures and leave the neck unscathed.

A disadvantage of such apparatus is that demonstration severing does not occur above or below the neck holding aperture.

Thus, in neither prior apparatus do demonstration apertures in which severing occurs completely surround the subject's neck.

In addition, as the U-shaped blade-is located behind the rectangular blade, it is not possible for spectators to view the apparatus from the rear, while opposite vertical edges of the blade also had to be concealed at all times in wood tracks which permitted the relative movement.

Furthermore, it was necessary to secretly relatively lower the U-shaped blade in the wood tracks during the performance. The wood handle had often to be relatively massive to conceal the rectangular blade therewithin in the relatively raised position.

SUMMARY OF THE INVENTION

It is an object of the invention to provide apparatus overcoming at least some of the above mentioned disadvantages to improve the illusory effect.

A particular object of the invention is to provide a magician's guillotine apparatus in which demonstration severing occurs at locations completely surrounding the subject's neck.

A further object of the invention is to provide such apparatus which permits spectator viewing from both the front and rear throughout the performance of an illusion.

An additional object of the invention is to provide largely transparent stocks enabling a spectator to see almost completely around the apertures and through the stocks thereby to increase the illusory effect.

According to one aspect of the invention there is provided a magician's guillotine apparatus comprising:

support frame means having a horizontal member and uprights upstanding in spaced apart relation from opposite ends thereof;

stock means supported vertically on the frame between the uprights and providing a primary, central aperture for holding a body part or other article not to be severed, such as a subject's neck, and upper, lower and lateral, demonstration apertures located above, below, and on respective opposite sides of the primary aperture for holding articles to be severed;

upper blade means;

means for mounting the upper blade means in the frame in selected first and second operating positions, respectively, for descending movement to extend, visible to a spectator, across the primary aperture and all demonstration apertures, severing any articles held therein, and for descending movement to extend visible to the spectator across only the upper and lateral demonstration apertures severing articles held therein, respectively;

a lower blade; and, means for mounting the lower blade concealed from the spectator's view within the horizontal frame member below the lower demonstration aperture in the first operating position of the upper blade means and, for raising the lower blade to extend visibly across the lower demonstration aperture to sever an article held therein, in the second operating position of the upper blade means, during descending movement thereof, after crossing the lateral apertures, so that all demonstration apertures have blade portions extending thereacross but a body part or other article held in the central aperture remains unscathed, providing an illusion to the spectator that a same blade has descended across all apertures. The lower blade rises too quickly for the different direction of movement to be ascertained by the spectator.

Further advantages of the invention will be apparent from the following description of a particular embodiment thereof.

BRIEF INTRODUCTION TO THE DRAWINGS

A specific embodiment of the invention will now be described by way of example only and with reference to the accompanying drawings in which.

DESCRIPTION OF PARTICULAR EMBODIMENT

Figure 1:
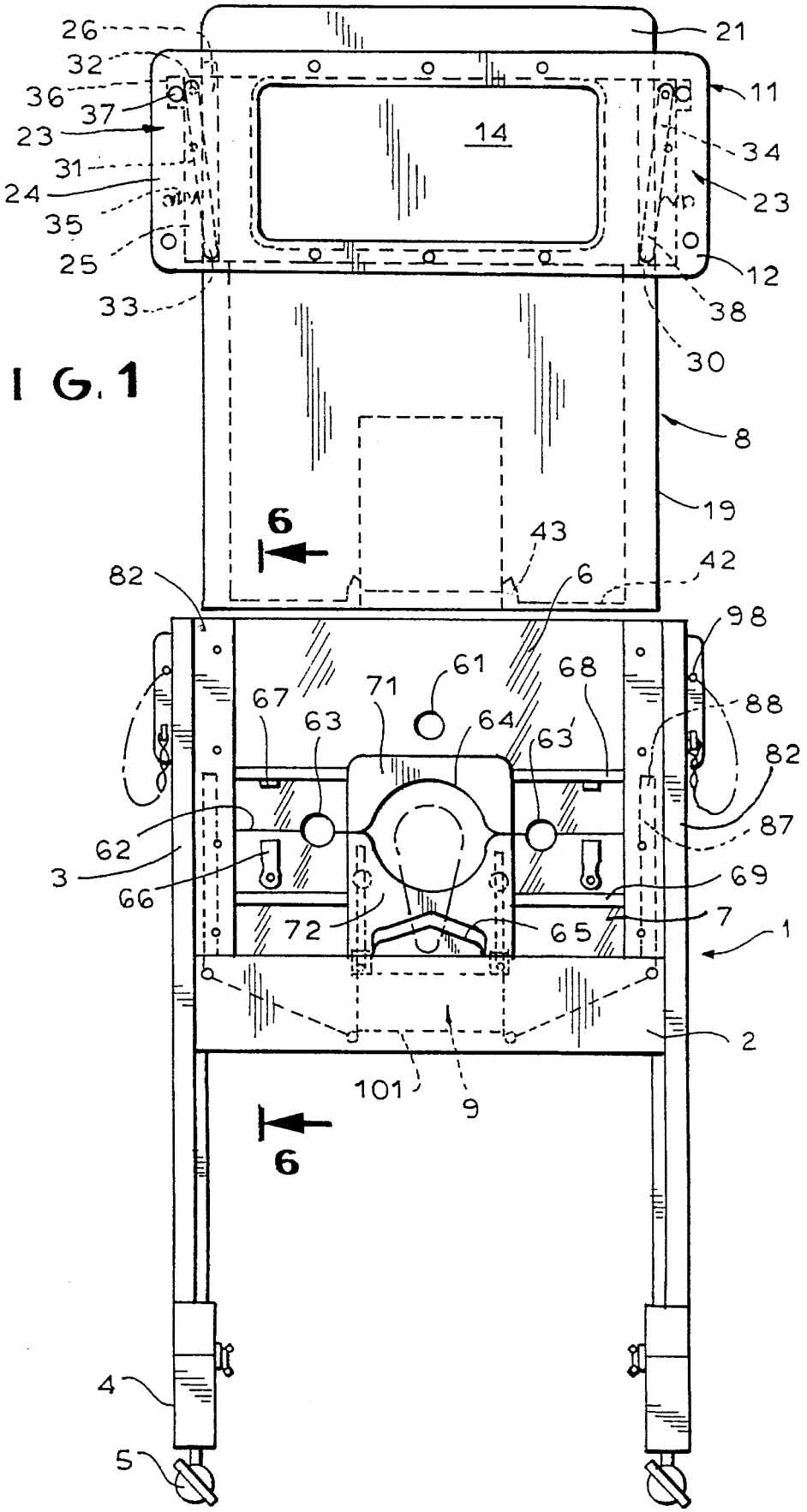
FIG. 1 is a front elevational view of the apparatus with the upper blade assembly raised and in a first operating position in which all articles held in apertures in the stocks will be severed by the upper blade assembly when the upper blade assembly descends.

As shown particularly in FIGS. 1–4, the magician's guillotine comprises a generally H-shaped outer wood frame 1 having a transverse frame member 2 extending horizontally between uprights 3 carried by forward and rearward extending feet 4 supported on casters 5; upper, removable and lower, fixed, transparent stocks 6 and 7, respectively, mounted on the transverse frame member between the uprights 3; an upper blade assembly 8 for sliding receipt between the uprights 3 and a lower blade mechanism 9 mounted in the frame concealed behind the transverse frame member 2.

Figure 3:
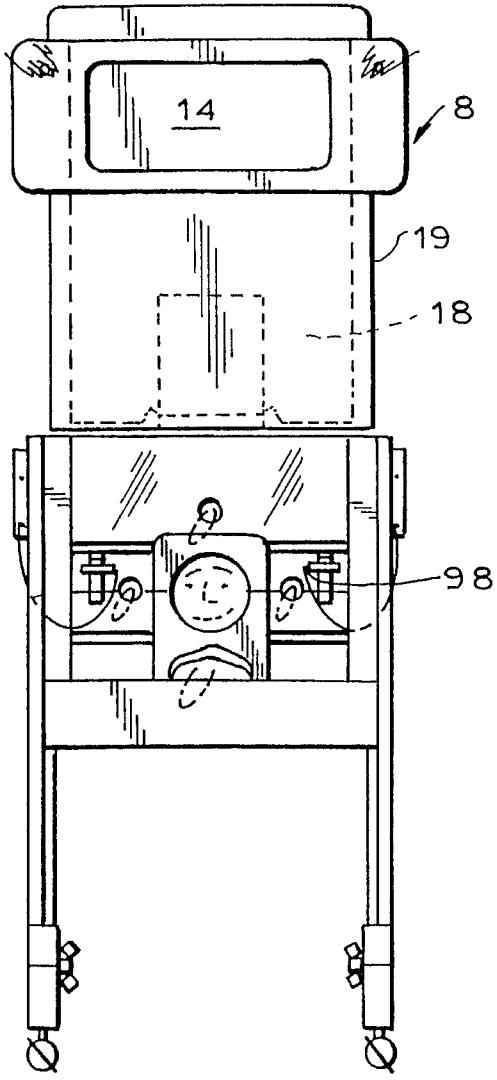
FIG. 3 is a similar view to FIG. 1 with the upper blade assembly raised and in a second operating position in which all articles held in demonstration apertures in the stocks will be severed when the upper blade assembly descends without affecting a subjects neck in the central, neck holding aperture.
Figure 2:
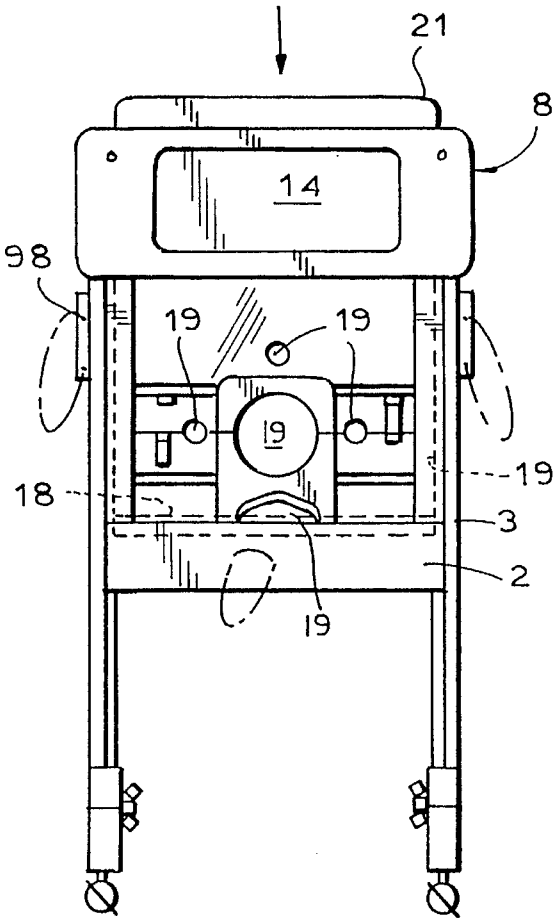
FIG. 2 is a similar view to FIG. 1 after the upper blade assembly has descended past all article holding apertures in the stocks thereby severing all articles therein.

Briefly stated, in performing the illusion, as shown in FIG. 1, in a first operating position in which the pins 98 are inserted in the frame uprights 3, and blades of the upper blade assembly are locked against relative movement, the magician places an article such as a large vegetable in the central aperture 64 in the stocks 6,7 and allows the upper blade assembly 8 to descend in the frame so as to be visible to the spectators across all apertures and severing the vegetable, as shown in FIG. 2. The magician then positions the neck of a volunteer subject from the audience closes the shackles 66 removes the pins from the uprights and inserts them in the shackles latching the stocks together, (and placing the frame in a second operation position). Articles (eg vegetables) are then placed in the demonstration apertures, as shown in FIG. 3. The magician them again allows the upper blade assembly 8 to descend in the frame severing all articles with all demonstration apertures having blade portions extending thereacross, completely surrounding the body part held in the central aperture which remains unscathed, providing an illusion to the spectator that a same blade has descended across all apertures and, to the suggestible, through the subject's neck.

Figure 8:
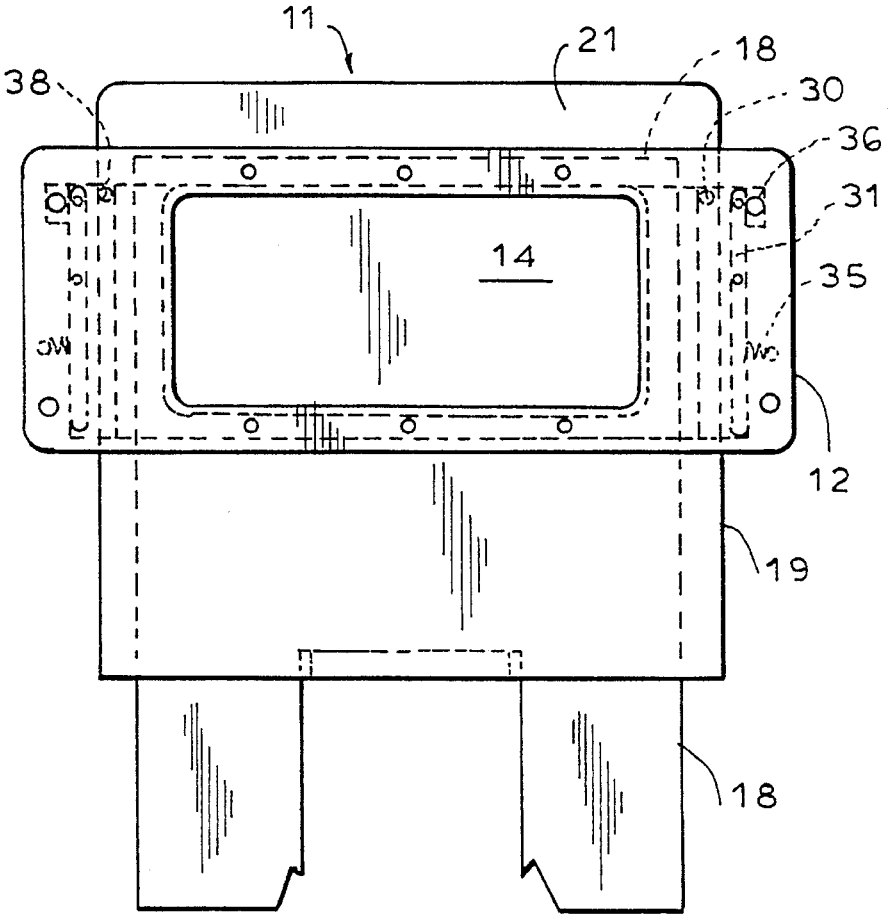
FIG. 8 is an elevational view of the upper blade assembly in the second operating position.
Figure 7:
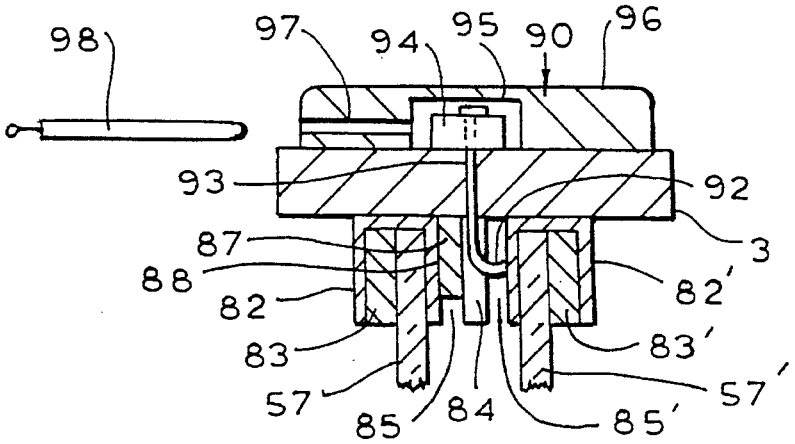
FIG. 7 is a cross-sectional view taken along line 7—7 of FIG. 6.
Figure 9:
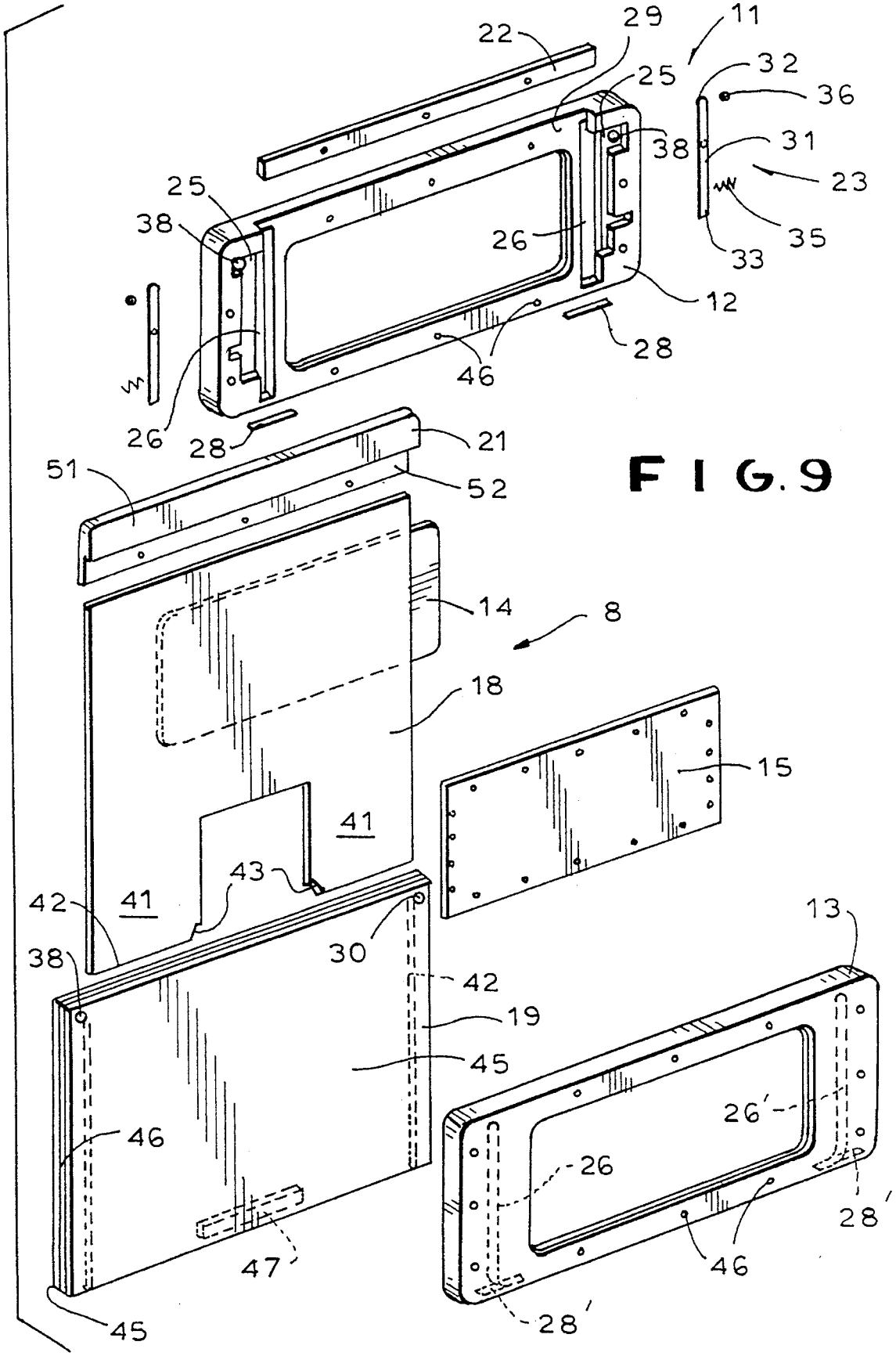
FIG. 9 is an exploded view of the upper blade assembly.
Figure 10:
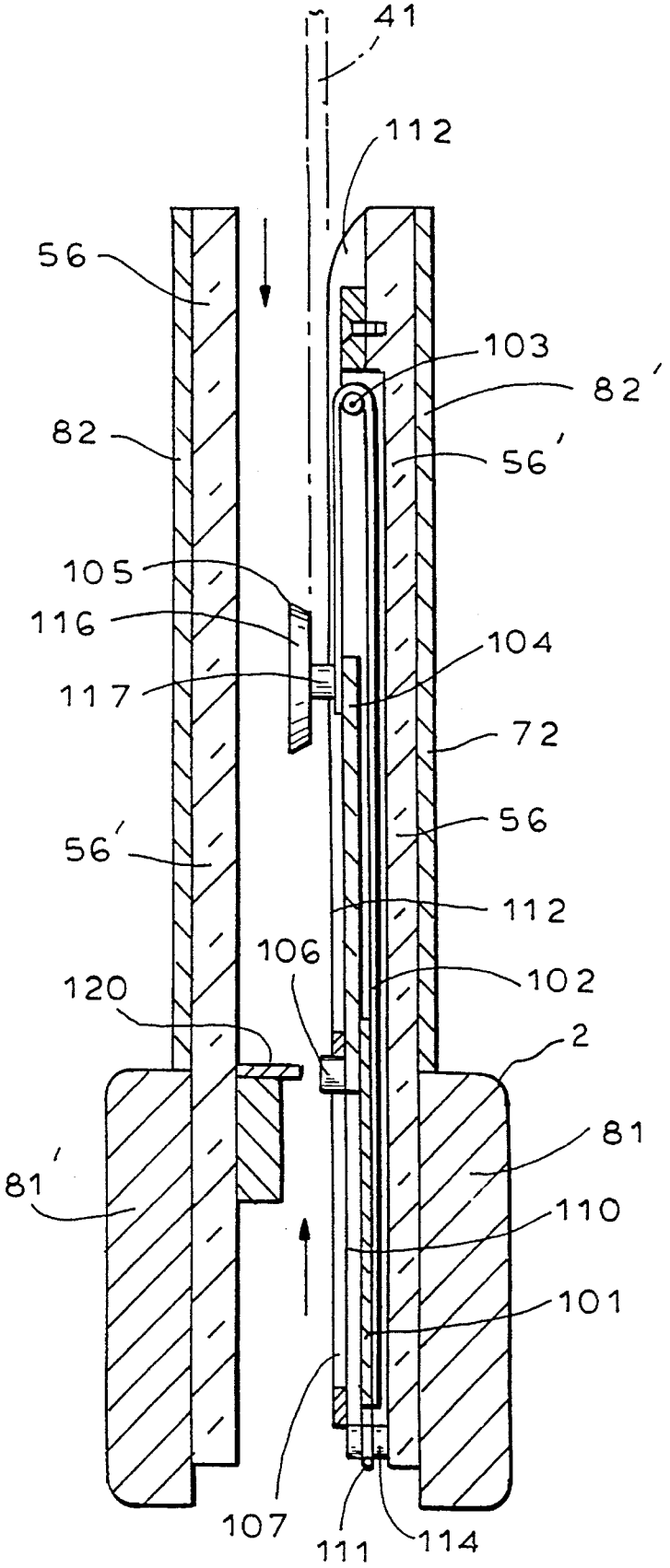
FIG. 10 is a schematic cross sectional view through the transverse frame member.

As shown more particularly in FIGS. 1, 8 and 9, the upper blade assembly 8 comprises an essentially bipartite frame-like wooden handle 11 having front and rear, frame-like handle members 12 and 13, respectively, of rectangular shape, front and rear aluminum face plates 14 and 15, a first, inner aluminum blade 18 of inverted U-shape, second, outer, tubular blade 19, an upper metal trim strip 21, a wood spacing strip 22 and releasable blade locking mechanisms 23.

Opposite minor sides 24 of the front handle member 12 have rear faces formed with vertical recesses 25 receiving elements of the blade locking mechanism 23 and deeper grooves forming vertical tracks 26 for receiving runners 30 of the second blade 19. Metal plates 28 are fastened to the lower major side to reinforce lower ends of both tracks 26. The rear side of the upper major edge is formed with a recess 29 for receiving the trim 21, strip 22 and upper edge of the first blade 18, as described below.

Each blade locking mechanism comprises a locking lever arm 31 with upper, actuating and lower, second blade engaging ends 32 and 33, respectively, and pivotally mounted at a medial location on a pivot pin 34. A compression biassing spring 35 engages the lever arm 31 at a location below the pivot pin to bias the lever arm 31 inward in a first operating, blade locking position. A thrust washer 36, carried by a bolt 37, captive in an oversize aperture 38 in the frame member engages the upper, actuating end 32 of the lever arm 31 so that manually effected inward movement of the bolt will pivot the lever arm 31 to the second operating position, shown in FIG. 8, compressing the biassing spring and withdrawing the end 33 from locking engagement with the upper edge 38 of the second blade to permit relative upward movement thereof further into the wood frame between face plates 14 and 15, guided by the runners 30 in the tracks 26 until the upper edge 38 adopts the position shown in broken lines in FIG. 8. This relative upward movement or lost motion occurs when the descent of the second blade 19 is arrested by engagement with the stops 87, described below.

The rear handle member is formed with a second pair of vertical, second blade guiding tracks 26' corresponding to the tracks 26, also terminating at metal reinforcing plates 28'.

The first, inner blade 18 has an upper body portion 40 from which depend a pair of spaced apart leg portions 41 having respective free ends 42 forming severing edges and hook forming cut outs 43 on respective inner corners thereof.

The second blade 19 comprises a pair of rectangular aluminum sheets 45, secured in spaced apart relation on spacers 46 which extend between respective opposite minor edges to form a tube for sliding receipt of the first blade 18. A metal strip 47 is mounted between the lower severing edges of the sheets to bridge the gap between the inner edges of the leg portions preventing severed material becoming plugged between the sheets during operation of the guillotine. Disc shaped runners 30 are attached to front and rear faces adjacent upper corners for receipt in guide tracks 26 of the handle members.

The metal trim 21 has an upper exposed edge portion 51 substantially equal in thickness to the thickness of the lower blade so as to appear to be a continuation thereof, and a lower milled step or rebate 52.

In the complete assembly, the first blade 18 is slidingly received in the second blade 19 with the leg portions 41 extending on respective opposite sides of the strip 47 to form a sub-assembly and the upper edge of the first blade 18 seated on the step 52 of the trim 21, received in the recess 29 in the front handle member. The strip 22 is laid on the exposed upper edge of the first blade 18, and the front and rear handle members secured together by bolts.

It should be noted that, contrary to appearances, nuts and bolts for receipt in the apertures 46 on the lower major side of the handle members do not extend through both handle members to clamp them together but are, in fact, dummies which permit the siding movement of the second blade 19 within the frame while deceiving the spectator. Thus, the trim 21, panels 14, 15 and second blade 19 appear to form coplanar surface portions of a single blade member, enabling the upper blade assembly to be observed from the front, rear and sides by spectators. The surfaces of those parts have a vertical satin finish grain which both enhances the illusion of isolated surface portions constituting the same blade and aids in concealing any scratches arising over time from wear.

Figure 5:
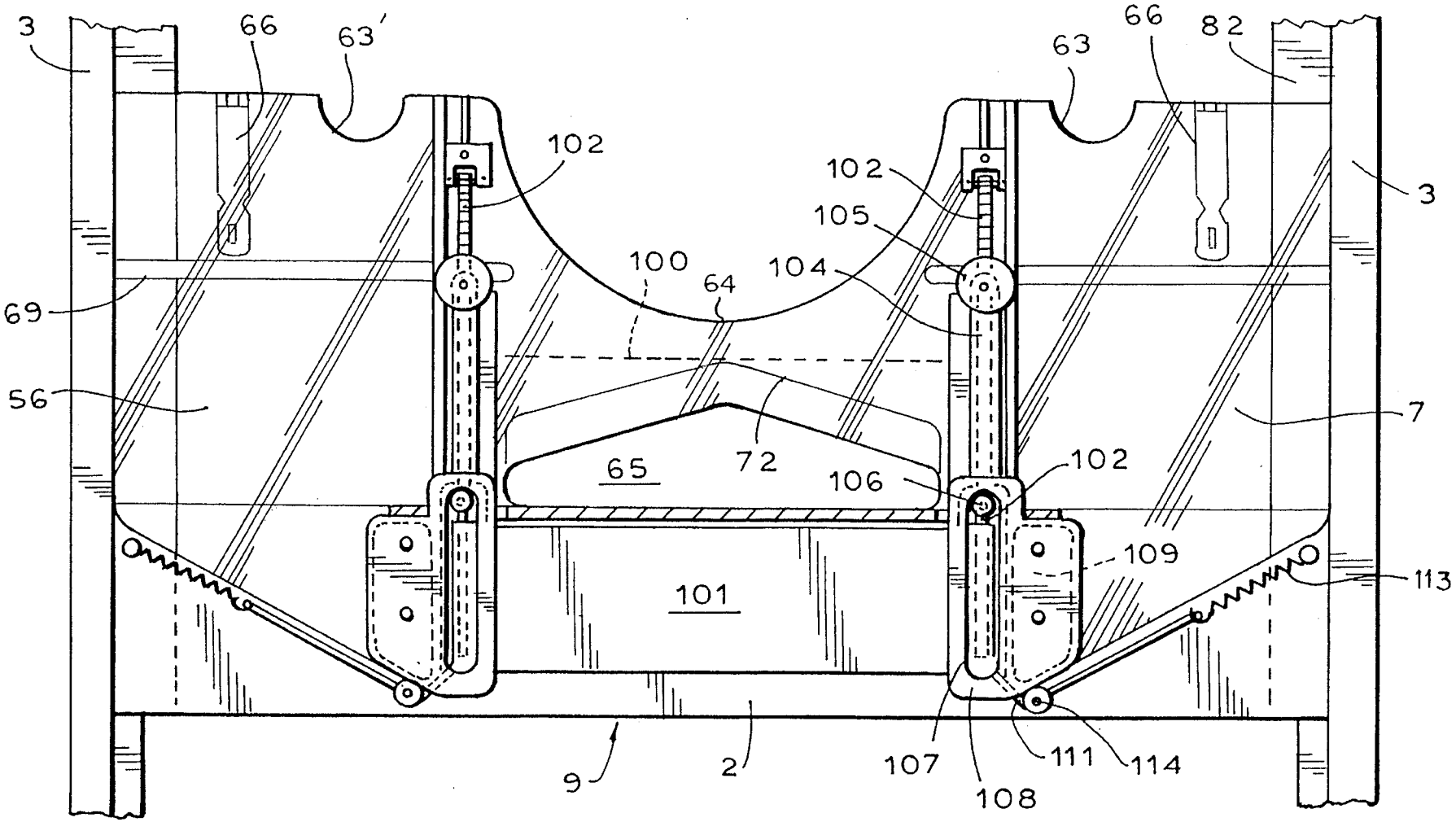
FIG. 5 is a front elevational view of a portion of a lower stock illustrating the lower blade mechanism.

As shown particularly in FIGS. 1, 5 and 9, the upper and lower stocks 6 and 7, respectively, each comprise front and rear, transparent acrylic panels 55, 55' and 56, 56' mounted in spaced apart relation on the frame. An upper, article receiving, demonstration aperture 61 and cut outs forming upper halves of lateral article receiving demonstration aperture 63, 63' and an upper half of a central body portion receiving aperture 64 are formed in the upper panels with complementary cut outs being formed in the lower front and rear panels. A lower, article receiving, demonstration aperture 65 is also formed below the central aperture by a cut out in the lower front panel. Complementary hinged hasps and catches, 66 and 67, respectively, are mounted on the respective fronts of lower and upper front panels below and above their junction, respectively.

A horizontal masking groove 68 is cut (sanded for opacity) in the front face of the upper front panel and a matching dummy groove 69 is cut in the front face of the lower front panel, so that the grooves appear to be provided solely for decorative purposes. Wooden masks portions 71, 72 having the profiles illustrated are mounted to the front and rear faces of the upper and lower transparent panels to completely surround the primary central aperture, and, together with the transverse frame member, to completely surround the lower demonstration aperture.

In the second operating position, during descent of the upper blade assembly 8, the upper groove 68 will conceal the lower edge of the second blade 19 from the view of the spectator, when descent thereof is stopped by the arresting strip 87, described below, while vertical portions of the masking wood will conceal the inner edges of the legs 41 and the outer vertical edges of the lower blade when raised across the lower aperture 65 together with vertically protruding portions of the lower blade mechanism, described below.

As shown more particularly in FIGS. 1, 6, 7 and 9, the transverse frame member 2 comprises front and rear, frame elements 81 and 81', respectively, which extend horizontally, spaced apart in parallel relation, bridging the uprights 3. Front and rear, channel section metal strips 82, 82', respectively, have respective base walls attached to opposed inside faces of respective uprights 3 so that the channels extend vertically in parallel, spaced apart relation. Wood filler strips 83, 83', respectively, having chamfered upper guiding ends are secured against front and rear walls of respective channel section metal strips. The acrylic panels 56, 56' of the lower stocks are retained in respective channels 82,82' and are attached to the inner faces of each transverse frame element 81,81", respectively, while the upper panels 57,57' are removably inserted in the upper portions of the respective channels 82, 82'. A wood divider strip 84 is attached to the inside face of each upright 3 midway between the channels 82, 82', forming front and rear tracks 85, 85' for sliding receipt of the blades 18, 19 of the upper blade assembly 11 in second and first operating positions, respectively. A wood arresting strip 87 is secured in the front track 85 with a blade engaging end 88 level with the masking groove guide 68.

A gate or switch mechanism 90 comprises a crank pin having a transverse blocking arm 92 on a shaft 93 mounted for free pivotal movement extending completely through the upright 3 with the opposite end anchored in a depending eccentric ballast 94 freely received in an concealed oversize cavity 95 formed in an inner face of a wood block 96 attached to the outside of the upright. A bore 97 for receiving a captive locking pin 98 extends into the block 90 from the front of the guillotine, into communication with the cavity.

In the first operating position of the switch, the locking pin 98 is inserted through the bore into engagement with the ballast 94 to retain the ballast in a position of unstable equilibrium in which the blocking arm 92 is aligned over the entry end of the front track 85.

Removal of the locking pin 98, in the second operating position of the switch, permits the ballast to swing freely within the cavity to a position of stable equilibrium, pivoting the blocking arm 92 rearward to bar blade entry to the rear track 85', permitting blade entry only to the front track 85 where the top of the arresting strip 87 will prevent the second blade 19 from descending across the central body part receiving aperture 64.

As shown more particularly in FIGS. 5 and 9, the lower blade mechanism 9 comprises a rectangular aluminum blade 101 secured at the front along respective opposite minor edge portions to respective first ends of drive bands 102, of a raising mechanism, which drive bands extend upward and are returned over sleeve rollers 103, secured to a rear face of the panel 56, and the drive bands are fastened at respective second ends to respective catch members 105. Each catch member 105 is attached to an upper end of an elongate, rigid metal rider 104 carrying, at a lower end, a plastic guide runner 106 received for sliding movement in a vertical guide slot 107 formed in a metal bracket 108 mounted to a space plate 109 secured to rear face of panel 56. The space plate 109 provides the gap 110 (FIG. 9) which receives the rider 104 during vertical movement thereof.

Strips of black, anti-friction tape (not shown) are secured to rear surfaces of respective riders and vertically extending strips of white anti-friction tape are secured to rear surfaces of opposite minor edge portions of the blade, respectively.

A lower blade return mechanism comprises cords 111 attached at respective first ends to respective lower front corners of the blade 100 and at respective second ends to respective return springs 113 anchored to the rear face of the front transverse frame member 81. The cords pass around respective pulleys 114 also anchored to the rear face of the front transverse frame member 81.

In the second operating position, the upper blade assembly descends in the front track so that the hook forming cut-outs 43 of the legs 41 of the first blade 18 engage the necks 117 of the catches 105, after descending across the lateral demonstration apertures 63, 63' forcing the catches to descend, guided by the rider 104 and guide runner 106 moving down the slot 107, and drawing down the returned end of the band 102 which raises the blade, against the action of the biassing spring 113, to the position shown in broken lines in FIG. 5 extending across the lower demonstration aperture. Vertical guides 112 of acrylic are provided on the rear face of the acrylic panel 56 for sliding engagement by the enlarged heads 116 of the catches to prevent severe misalignment. When the blade assembly is raised after performance of the illusion, the return springs ensure return and retention of the blade in the concealed position.

A black masking plate 120 having cut outs to accommodate protruding portions of the blade actuating mechanism protrudes forward from the rear transparent panel 56 level with the tops of the transverse frame members to conceal the blade mechanism from spectators looking down at an oblique angle from in front of or behind the apparatus.

Figure 6:
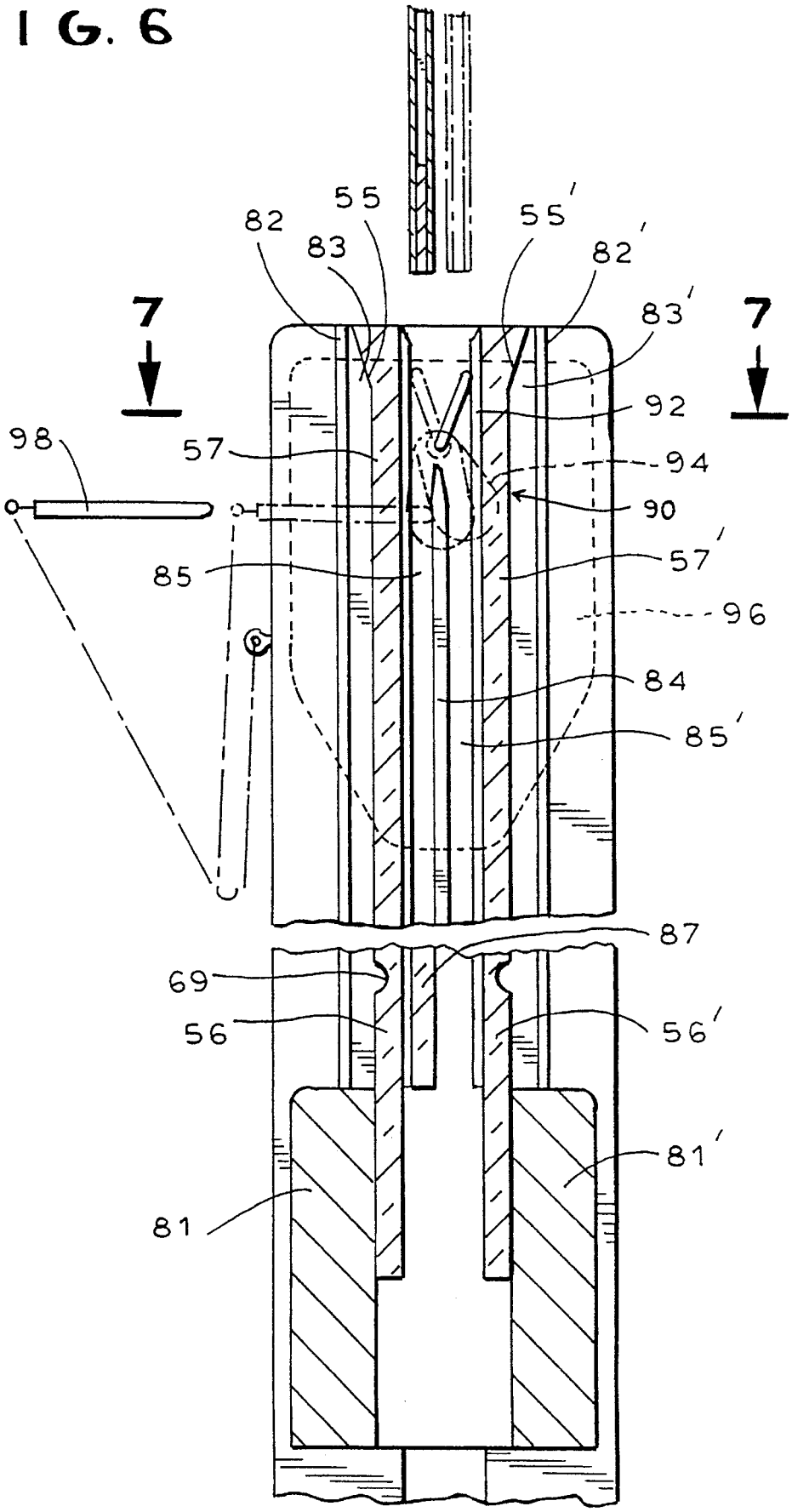
FIG. 6 is a fragmentary sectional view taken along line 6—6 of FIG. 1.

In performing the illusion, the magician places the apparatus in the first operating position shown in FIG. 1 in which the pins 98 are inserted in the frame uprights 3 into engagement with the ballast 94 to maintain it in a rear position of unstable equilibrium in which the blocking arm obstructs entry to the front slot as shown in broken lines in FIG. 6. The lower end of the locking arm 33 is retained by biassing spring 35 in locking engagement with the upper edge of the second blade 19, retaining the blade completely surrounding the first inner blade 18, locked against relative movement. The magician places an article such as a large vegetable in the central aperture 64 defined by the stocks 6,7 and inserts the upper blade assembly 8 in the rear guide 85' permitting it to descend in the frame between the front and rear panels 57,57'; 56,56' with the lower edge of the second blade severing the vegetable, and so that substantially the entire blade can be seen through the transparent stocks and extends across all apertures, as shown in FIG. 2.

The magician then removes the upper blade assembly, slides up the upper stocks 57,57' and positions the neck of a volunteer subject from the audience between the upper and lower stocks, lowers the upper stocks so that the neck is in the central aperture 64, and closes the shackles 65, 66, removes the pins 98 from the uprights and inserts them in the shackles latching the stocks together. Removal of the pins permits the ballast to swing under gravity to a stable position of equilibrium, pivoting the blocking arm 92 to block blade entry to the rear slot, as shown in solid lines in FIG. 6, placing the frame in a second operating position. Articles (eg vegetables) are then placed in all the demonstration apertures, thereby completely surrounding the subjects head, as shown in FIG. 3.

The magician them inserts the upper blade assembly into the front slot 85, guiding its early descent, while keeping his fingers covering the movable bolts 37 and pushing the bolts 37 inward during the descent, without the spectators perceiving such movement. The inward movement of the bolts causes the thrust washer to move the upper ends 32 of the locking arms inward pivoting the lower ends 33 out from engagement with the upper edge of the second blade, as shown in FIG. 8. This frees the second blade 19 for relative movement or lost motion up the tracks 26 when its descent is arrested by engagement with the upper end of the arresting strip 87. The lower edge is then hidden behind the upper groove 68. The inner blade 18 and handle continue their descent severing articles in the lateral demonstration apertures 63,63', after which the hook forming cut-outs 43 of the legs 41 of the first blade 18 engage the necks 117 of the catches 105, raising the lower blade, as described above.

Figure 4:
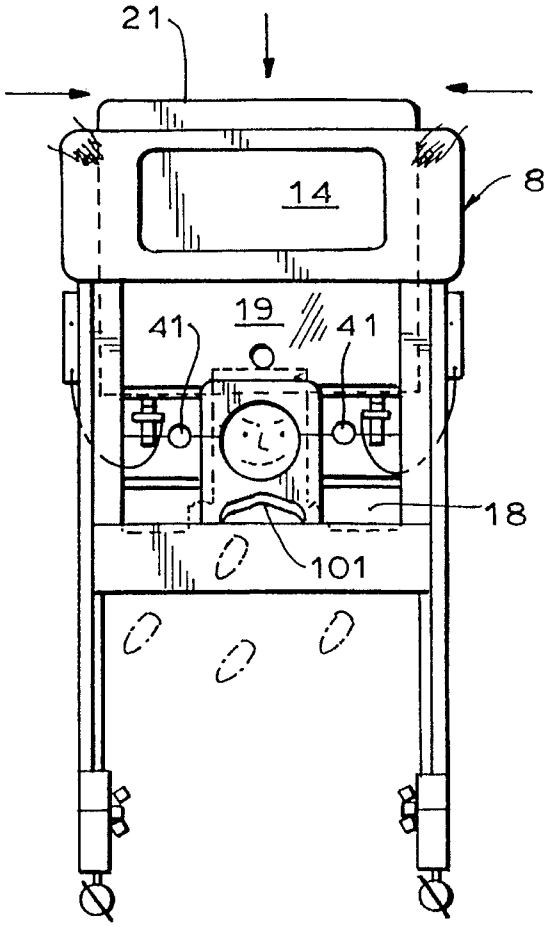
FIG. 4 is a similar view to FIG. 1 after the upper blade assembly has descended past all apertures in the stocks thereby severing all articles therein except a subjects neck in the central, neck holding aperture which remains unscathed.

Thus, as shown in FIG. 4, all articles with all demonstration apertures having blade portions extending thereacross, completely surround the body part held in the central aperture which remains unscathed. Although the second blade 19 is exposed in the area of stocks above the groove 68, and the legs 41 of the first blade occupy all remaining locations of the stocks except those within the wood masking surrounding the lower demonstration aperture which are covered by the lower blade 101, the illusion is provided to spectators that the same blade has descended across all apertures and, to the suggestible, through the subject's neck.

I claim:

1. A magician's guillotine apparatus comprising:

support frame means having a horizontal member and uprights upstanding in spaced apart relation from opposite ends thereof;

stock means supported vertically on the frame between the uprights and providing a primary, central aperture for holding an article not to be severed and upper, lower and lateral, demonstration apertures located above, below, and on respective opposite sides of the primary aperture for holding articles to be severed;

upper blade means;

means for mounting the upper blade means in the frame in selected first and second operating positions, respectively, for descending movement to extend, visible to a spectator, across the primary aperture and all demonstration apertures, severing any articles held therein, and for descending movement to extend visible to the spectator across only the upper and lateral demonstration apertures severing articles held therein, respectively;

a lower blade; and, means for mounting the lower blade concealed from the spectator's view within the horizontal frame member below the lower demonstration aperture in the first operating position of the upper blade means and, for raising the lower blade to extend visibly across the lower demonstration aperture to sever an article held therein, in the second operating position of the upper blade means, during descending movement thereof, after crossing the lateral apertures, so that all demonstration apertures have blade portions extending thereacross but the article held in the central aperture remains unscathed, providing an illusion to the spectator that a same blade has descended across all apertures.

2. Apparatus according to claim 1 in which at least portions of the stocks surrounding the upper and lateral demonstration apertures are made from transparent material, the apparatus further comprising lower blade masking means having a portion extending horizontally across the stocks between the central aperture and the lower demonstration aperture concealing from a spectator's view an upper severing edge of the lower blade when extending across the lower aperture.

3. Apparatus according to claim 2 in which:

the upper blade means comprises first and second blade members, the first blade member being of inverted U-shape, having a pair of legs depending in spaced apart relation from a transverse body and the second blade member being rectangular, means are provided for assembling the blade members together in face to face relation with the second blade member extending transversely of the first blade member for relative vertical sliding movement;

second blade member arresting means concealed between the upper, demonstration aperture and the central, primary aperture;

releasable means for locking the first and second blade members together in the first operating position preventing said sliding movement and with the second blade member extending below the first blade member so that the first and second blade members descend together with a lower severing edge of the second blade member moving across all apertures to sever articles held therein;

said locking means being releasable in the second operating position permitting both blade members initially to descend together until a central portion of the lower transverse edge of the second blade member has moved across the upper aperture severing an article therein and is arrested by the arresting means and continued descent of the first blade member so that lower ends of the leg portions move across the lateral demonstration apertures, severing articles therein with the central aperture aligned with a space between the legs.

4. Apparatus according to claim 3 further comprising second blade masking means extending across the stocks in horizontal alignment with the arresting means between the upper demonstration aperture and the central aperture to conceal the lower edge of the second blade member stopped by the arresting means from the spectator's view, the lower blade being rectangular and the lower blade masking means comprising portions extending vertically between the horizontal frame member and the horizontally extending portion thereby to mask vertically extending edges of the lower blade.

5. Apparatus according to claim 4 in which the second blade masking means is a horizontal groove formed in the transparent material.

6. Apparatus according to claim 3 in which the second blade member of the upper blade means comprises a flat tube in which the first blade member is inserted.

7. Apparatus according to claim 3 in which the means for assembling the first and second blade members includes a frame forming handle in which the releasable locking means are concealed and bolts are provided extending through the handle so as to appear to a spectator to secure opposite faces of the handle together with selected of said bolts manually movable by a user while holding the frame means to guide the upper blade means into the frame for descending movement across the apertures to effect release of the locking means.

8. Apparatus according to claim 3 in which the uprights of the frame means are formed with first and second, vertically extending, upper blade assembly receiving tracks which have entry ends at tops of the uprights, the first track descending completely passed the stocks to the horizontal frame member and the arresting means being formed by a stop in the second track, gate means provided at the entry ends operable to block selected of the second and first tracks in the first and second operating positions, respectively.

9. Apparatus according to claim 8 in which the gate means comprise arm means pivotally mounted in a concealed position in an upright at entry ends of the tracks for pivotal movement between positions blocking entry ends of the second and first tracks, respectively, by insertion into, and removal of a locking pin from the uprights, into and out of engagement with the lever arm means, respectively.

10. A magician's guillotine apparatus of a type comprising:

an upper blade assembly having a first blade of inverted U-shape and a second blade of rectangular shape;

means mounting the first and second blades together for relative vertical sliding movement in face to face relation between alternate severing positions in which the second blade is moved into and out from bridging relation with lower ends of legs of the first blade, respectively;

the improvement residing in that the second blade comprises a flat tube which slidingly receives at least a lower portion of the first blade in one severing position thereby concealing the said at least lower portion of the first blade from spectators viewing opposite faces.

11. A magician's guillotine apparatus of a type comprising:

an upper blade assembly including first and second blades;

handle means receiving therein the first and second blades mounted together, with the second blade in front of the first blade for relative vertical sliding movement in face to face relation between alternate severing positions in which the second blade is moved into and out of the handle, respectively;

the improvement residing in that the handle comprises a rectangular frame having upper and lower cross pieces and a front face plate extends between the cross-pieces in substantial alignment with the second blade and is made of the same material as the second blade so as to appear to be a continued portion of the second blade.

* * * * *